US007283050B2

(12) United States Patent
Minowa

(10) Patent No.: US 7,283,050 B2
(45) Date of Patent: Oct. 16, 2007

(54) CERTIFYING SYSTEM, RADIO TAG, CERTIFYING METHOD AND CERTIFYING PROGRAM

(75) Inventor: Masaharu Minowa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 176 days.

(21) Appl. No.: 11/020,170

(22) Filed: Dec. 27, 2004

(65) Prior Publication Data

US 2006/0055507 A1 Mar. 16, 2006

(30) Foreign Application Priority Data

Aug. 30, 2004 (JP) ..... 2004-249451

(51) Int. Cl.
*G08B 13/14* (2006.01)

(52) U.S. Cl. ..... 340/572.1; 340/539.13; 340/5.2; 235/385

(58) Field of Classification Search ..... 340/572.1
See application file for complete search history.

(56) References Cited

U.S. PATENT DOCUMENTS 5,664,113 A * 9/1997 Worger et al. ..... 705/28
5,774,876 A * 6/1998 Woolley et al. ..... 340/572.1
6,483,434 B1 * 11/2002 UmiKer ..... 340/572.1
6,624,739 B1 * 9/2003 Stobbe ..... 340/5.2
6,867,683 B2 * 3/2005 Calvesio et al. ..... 340/5.52
6,954,148 B2 * 10/2005 Pulkkinen et al. ..... 340/572.1
6,963,277 B2 * 11/2005 Imasaki et al. ..... 340/539.1
7,005,968 B1 * 2/2006 Bridgelall ..... 340/572.1
7,019,644 B2 * 3/2006 Barrie ..... 340/539.13
7,076,083 B2 * 7/2006 Blazey ..... 340/5.7
7,084,736 B2 * 8/2006 Ritter ..... 340/5.6
2004/0169589 A1 * 9/2004 Lea et al. ..... 340/539.13
2005/0087596 A1 * 4/2005 Larson et al. ..... 340/5.2

* cited by examiner

*Primary Examiner*—Benjamin C. Lee
*Assistant Examiner*—Eric M. Blount
(74) *Attorney, Agent, or Firm*—Kratz, Quintos & Hanson, LLP

(57) ABSTRACT

A certifying system for checking validity of a radio tag passing through a predetermined route includes a route information writing section that writes information relating to a route passed by the radio tag on the radio tag, a route information acquisition section that acquires information relating to the route written on the radio tag by the route information writing section, a storage section that stores information relating to a regular route preset corresponding to the ID of the radio tag, and a certifying section that checks the validity based on the information relating to the route written on the radio tag acquired by the route information acquisition section and the information relating to the regular route stored in the storage section.

19 Claims, 13 Drawing Sheets

CERTIFYING SYSTEM, RADIO TAG, CERTIFYING METHOD AND CERTIFYING PROGRAM

BACKGROUND OF THE INVENTION

1. Field of the Invention

The present invention relates to a certifying system using a radio tag, a radio tag, a certifying method and a certifying program.

2. Description of Related Art

Heretofore, in a security system for permitting unlocking of a door, a log-in and the like to a PC (personal computer) by executing certification, a technique is well-known for using an ID (identification) card at the time of certification by previously writing information for taking a permission of the certification on the ID card.

If the above-mentioned ID card, on which the information and the like for taking the permission of the certification is written, is handed over to another person as a result of a theft and the like, it is possible for the ID card to be simply abused by the another person. Further, as long as the theft of the ID card is not discovered, there is a possibility that the ID card is being continuously abused for a long period.

When the theft of the ID card is discovered, it is necessary that the theft of the ID card is registered on a system for certifying according to the ID card and that the certification according to the stolen ID card is prohibited. Thus, this requirement increases the number of man-hours required for managing the security system.

SUMMARY OF THE INVENTION

The present invention solves the above-mentioned problems and has an object of providing a certifying system, a radio tag, a certifying method and a certifying program which are capable of contributing to the prevention of an abuse of an ID card and a decrease in the number of man-hours required for managing a security system.

To attain the above-mentioned object, a certifying system for checking the validity of a radio tag passing through a predetermined route according to the present invention comprises a route information writing section, disposed along the predetermined route, that writes information relating to a route passed by the radio tag on the radio tag, a route information acquisition section that acquires the information relating to the route written on the radio tag by the route information writing section, a storage section that stores information relating to a regular route preset corresponding to the ID of the radio tag, and a certifying section that checks the validity based on the information relating to the route written on the radio tag acquired by the route information acquisition section and the information relating to the regular route stored in the storage section.

The certifying system according to the present invention further comprises a plurality of route information writing sections, disposed along a predetermined route, that write information relating to the route passed by the radio tag on the radio tag passing through the predetermined route, a route information acquisition section that acquires the information relating to the route written on the radio tag by the route information writing section, and a certifying section that certifies based on the information relating to the route written on the radio tag acquired by the route information acquisition section and the information relating to the regular route preset corresponding to the ID of the radio tag.

Such a structure can automatically refuse the certification of the radio tag passed, for example, through the route except the preset regular route as an illegally used tag not passing through the regular route. That is, this can contribute to a prevention of an abuse of the ID card and a reduction in the man-hours required for management of the security system.

It is desirable that in the certifying system of the above-mentioned structure, information relating to the route passed by the radio tag includes information relating to a passing spot of the radio tag.

Further, the certifying system of the above-mentioned structure may include an NG flag writing section that writes an NG flag for inhibition of use of the radio tag not permitted for the certification in the certifying section, and the certifying section may not permit the certification for the radio tag with the NG flag written.

Such a structure thus formed can automatically inhibit the use of the abused ID card with the NG flag written on the radio tag refused for the certification.

It is preferable that the certifying system of the above-mentioned structure includes a gate lock control section that unlocks and locks a gate installed on the predetermined route, and the gate lock control section locks the gate if the certification is not permitted in the certifying section.

Such a structure can prevent a person who abuses the ID card (that is, a person who has no authority for passing a gate) from passing the gate and can contribute to an improvement in a security level.

The certifying system of the above-mentioned structure includes a period-of-validity information writing section that writes a period of validity of the radio tag on the radio tag, and the certifying section does not permit the certification for the radio tag expiring the written period of validity.

Even if the ID card is, for example, stolen, such a structure can previously set a period of validity on the ID card, and after the period of validity expires, the ID card is made to be prohibited to take the certification. Thus, even if the theft of the ID card is not noticed, the ID card is prevented from being abused for a long period exceeding the above-mentioned period of validity.

The certifying system of the above-mentioned structure comprises a password information setting section that sets password information for taking the permission of the certification in the certifying section, a password information writing section that writes the password information set by the password information setting section on the radio tag, a password information acquisition section that acquires the password information written on the radio tag by the password information writing section, and a password information input section that inputs password information used for comparing with the password information set by the password information setting section. It is desirable that the certifying section certifies based on the password information written on the radio tag acquired by the password information acquisition section and the password information inputted by the password information input section.

Such a structure thus formed can certify an owner of the radio tag (ID card) passing through the regular route to further identify the individual. That is, even if the owner of the stolen ID card passes the regular route, the certification can be refused.

The certifying system of the above-mentioned structure may include a position information writing section that writes information relating to the present position of the radio tag on the radio tag, and a process permitting section that permits only a predetermined process to be permitted at the present position based on the information relating to the present invention written on the radio tag, when the certifying section permits the certification.

In such a structure thus formed, the certification to the radio tag (ID card) owner's present position is valid, but a process not to be permitted for a person existing at the present position (for example, access and the like to system resources via a network) can be inhibited.

According to the present invention, there is provided a radio tag that comprises a radio antenna and a memory section and that is capable of being accessed by a radio signal from a read-write unit arranged along the predetermined route. The memory section stores information relating to the route through which the radio tag passes. The radio tag is written by the read-write unit.

A certifying method according to the present invention comprises a route information writing step of writing information relating to a route passed by a radio tag on the radio tag disposed along a predetermined route and passing through the predetermined route, a route information acquiring step of acquiring information relating to the route written on the radio tag in the route information writing step, and a certifying step of certifying based on the information relating to the route written on the radio tag acquired in the route information acquiring step and the information relating to a regular route preset corresponding to the ID of the radio tag.

In the certifying method described above, information relating to the route passed by the radio tag may include information relating to the passing spot of the radio tag.

The certifying method described above comprises an NG flag writing step of writing an NG flag for inhibiting the use of the radio tag not permitted for the certification in the certifying step. It is desirable that the certifying step has a composition for not permitting the radio tag with the NG flag written for certification.

The certifying method described above comprises a gate lock control step of unlocking and locking a gate installed on the predetermined route. The gate lock control step may lock the gate if the certification is not permitted in the certifying step.

The above-described certifying method comprises a period-of-validity information writing step of writing a period of validity of the radio tag on the radio tag. It is preferable that the certifying step does not permit the certification for the radio tag expiring the written period of validity.

The above-described certifying method comprises a password information setting step of setting password information for taking the permission of the certification in the certification step, a password information writing step of writing the password information set by the password information setting step on the radio tag, a password information acquiring step of acquiring the password information written on the radio tag by the password information writing step, and a password information inputting step of inputting the password information used for comparing with the password information set by the password information setting step. The certifying step may certify based on the password information written on the radio tag acquired by the password information acquiring step and the password information input by the password information inputting step.

It is preferable that the certifying method comprises a position information writing step of writing information relating to the present position of the radio tag on the radio tag, and a process permitting step of permitting only a predetermined process to be permitted at the present position based on the information relating to the present position written on the radio tag.

A certifying program according to the present invention is characterized by allowing a computer to execute an information acquiring step of acquiring information relating to a route passed by a radio tag and written on the radio tag, a certifying step of certifying based on the information relating to the route written on the radio tag acquired by the information acquiring step and the information relating to a regular route preset corresponding to the ID of the radio tag, and a route information writing step of writing the information relating to the route passed by the radio tag on the radio tag permitted for the certification in the certifying step.

In the certifying program of the above-mentioned structure, the certifying step includes an NG flag writing step of writing an NG flag for inhibiting the use on the radio tag not permitted for the certification. It is preferable that the certifying step does not permit the certification for the radio tag with the NG flag written.

The certifying program according to the present invention is characterized by allowing the computer to execute an information acquiring step of acquiring the information relating to the route passed by the radio tag and written on the radio tag, a certifying step of certifying based the information relating to the route written on the radio tag acquired by the information acquiring step and the information relating to the regular route preset corresponding to the ID of the radio tag, and a gate lock control step of locking a gate installed on the predetermined route if the certification is not permitted in the certifying section.

In the certifying program of the above-mentioned structure, the radio tag not permitted for the certification in the certifying step includes an NG flag writing step of writing the NG flag for inhibiting the use of the radio tag. It is preferable that the certifying step does not permit the certification for the radio tag with the NG flag written.

In addition, the certifying program according to the present invention allows the computer to execute an information acquiring step of acquiring the information relating to the route passed by the radio tag and written on the radio tag, and a certifying step of certifying based the information relating to the route written on the radio tag acquired by the information acquiring step and the information relating to the regular route preset corresponding to the ID of the radio tag.

The certifying program according to the present invention includes an NG flag writing step of writing an NG flag for inhibiting the use of the radio tag not permitted for the certification in the certifying step. It is preferable that the certifying step does not permit the certification on the radio tag with the NG flag written.

It is preferable that the certifying program according to the present invention allows the computer to execute an information acquiring step of acquiring the information relating to the route passed by the radio tag, written on the radio tag and the information relating to the present position of the radio tag, written on the radio tag, a certifying step of certifying based on the information relating to the route written on the radio tag acquired by the information acquiring step and the information relating to the regular route preset corresponding to the ID of the radio tag, and a process permitting step of permitting only a predetermined process to be permitted at the present position based on the information relating to the present position acquired by the information acquiring step if the certification is permitted in the certifying section.

The above-mentioned certifying program can be executed by the computer for constructing the certifying system by storing in a computer readable recording medium. As the computer readable recording medium, a portable storage medium, such as a semiconductor storage device and the like including a CD-ROM, a flexible disc, a DVD disc, a magneto-optic disc, an IC card and the like, a fixed storage unit, such as a ROM, a RAM, a magnetic recorder and the like to be mounted in a computer, a database for holding a computer program, or other computer as well as its database, and further a transmission medium in a channel are included.

Thus, the respective steps in the above-mentioned certifying method are realized by executing the certifying program in a computer.

According to the present invention as described in detail above, a certifying system, a radio tag, a certifying method and a certifying program which can contribute to a prevention for an abuse of an ID card and a reduction in man hour in a management of a security system can be provided.

DETAILED DESCRIPTION OF THE PREFERRED EMBODIMENTS

In the following, embodiments of the present invention will be described in details with reference to the drawings.

Figure 1:
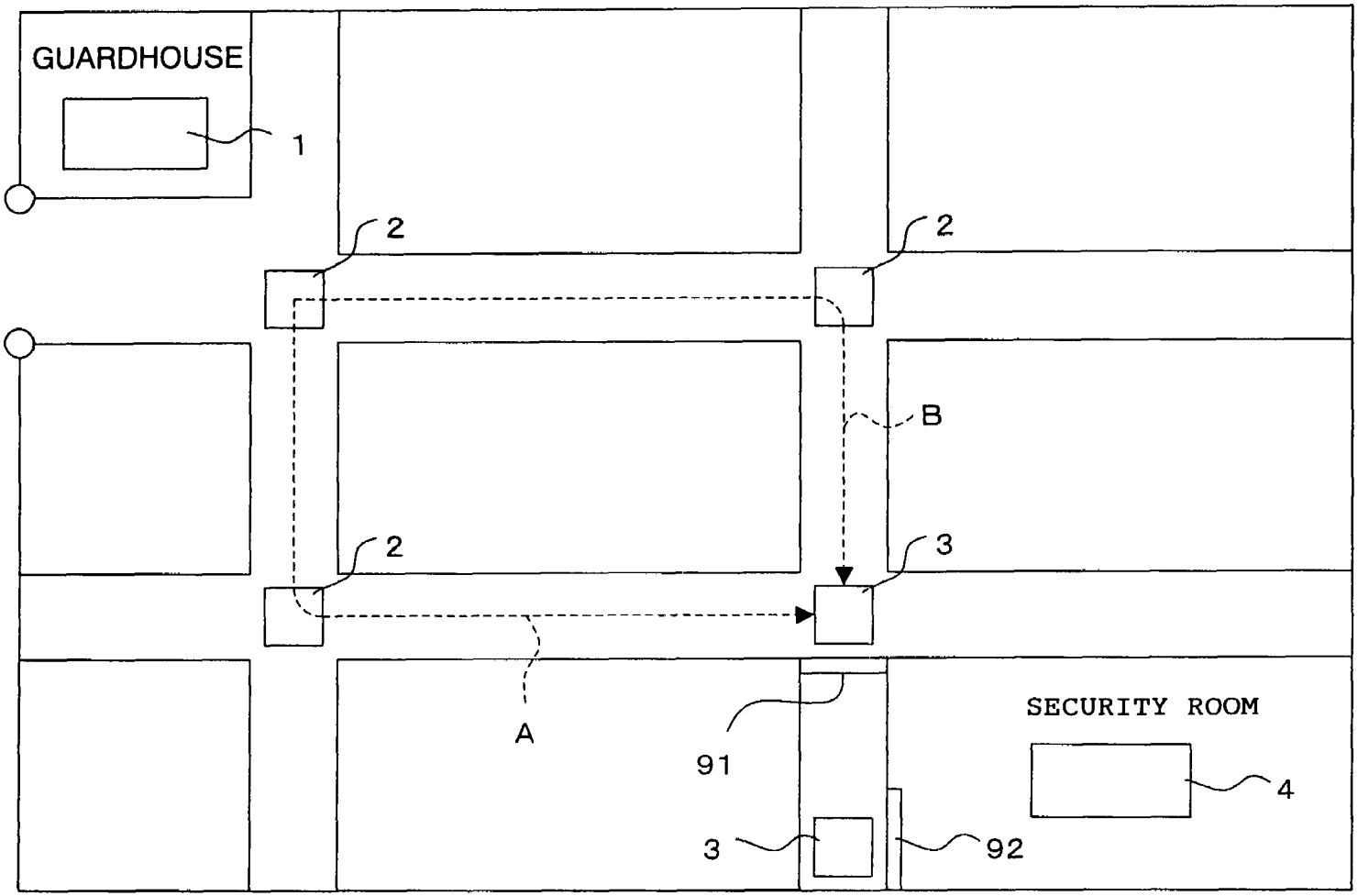
FIG. 1 is a view for explaining the structure of an entire certifying system according to an embodiment of the present invention.

FIG. 1 is a view for explaining the structure of the entire certifying system according to this embodiment. The certifying system according to this embodiment has a role of checking the validity of a radio tag passing through a predetermined route.

The certifying system according to this embodiment comprises a lending information writing section 1, a route information writing section 2, a gate lock control section 3, a resource use terminal 4 and a remote resource managing section 5, and certifies by using the radio tag. More particularly, the radio tag or an IC card and the like having the radio tag is used, and will be hereinafter generally called a radio tag. Here, the radio tag includes a radio antenna and a memory section, and can be accessed by a radio signal from a read-write unit disposed along a predetermined route. Incidentally, in the same drawing, the remote resource managing unit 5 is not shown. The remote resource managing unit 5 will be described in detail later (Refer to FIG. 14). It is noted that the resource use terminal 4 is disposed in a security room separated via lockable gates 91 and 92.

Figure 2:
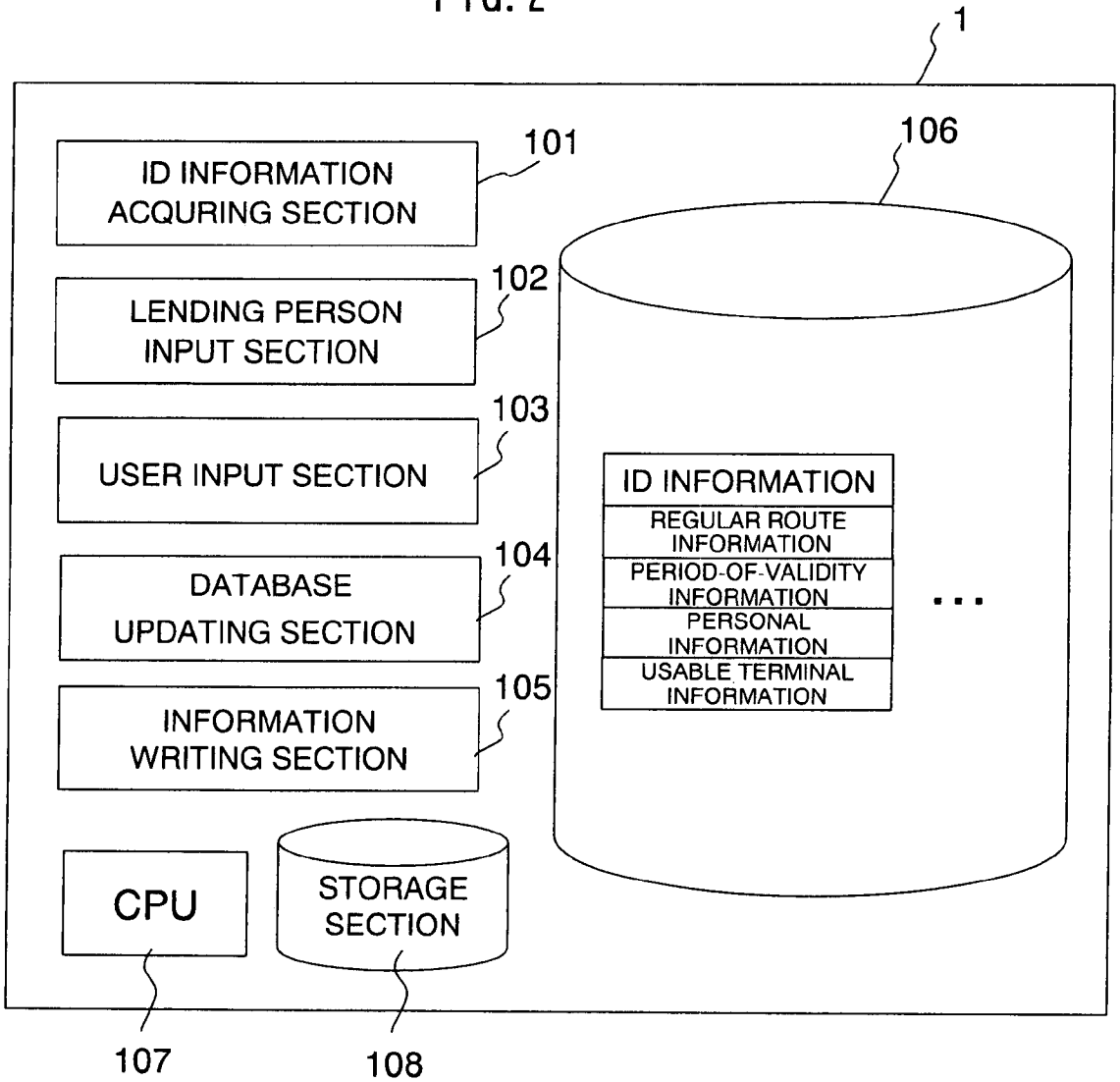
FIG. 2 is a functional block diagram for explaining the structure of a lending information writing section 1.

The lending information writing section 1 is disposed at a place where a radio tag is lent, such as an entrance of a building, a guardhouse and the like. FIG. 2 is a functional block diagram for explaining the structure of the lending information writing section 1. The lending information writing section 1 includes an ID information acquiring section 101, a lending person input section 102, a user input section 103, a database updating section 104, an information writing section 105, a database 106, a CPU 107 and a storage section 108. The lending person input section 102 and the user input section 103 are constructed, for example, by a keyboard, a mouse and the like. Here, the role as the read-write unit to the radio tag is realized by the ID information acquiring section 101 and the information writing section 105.

A database 106 of this embodiment, a database 205, database 304, a database 406 and a database 505 to be described later each has a role as a subset. The same name of the information stored in these databases has the same contents. It is noted that a plurality of the databases are not disposed as the subsets, but all the information in the above-mentioned subset databases are stored in one database. The data in this one database may be referred to from the lending information writing section 1, the route information writing section 2, the gate lock control section 3, the resource use terminal 4 and the remote resource managing unit 5.

Figure 3:
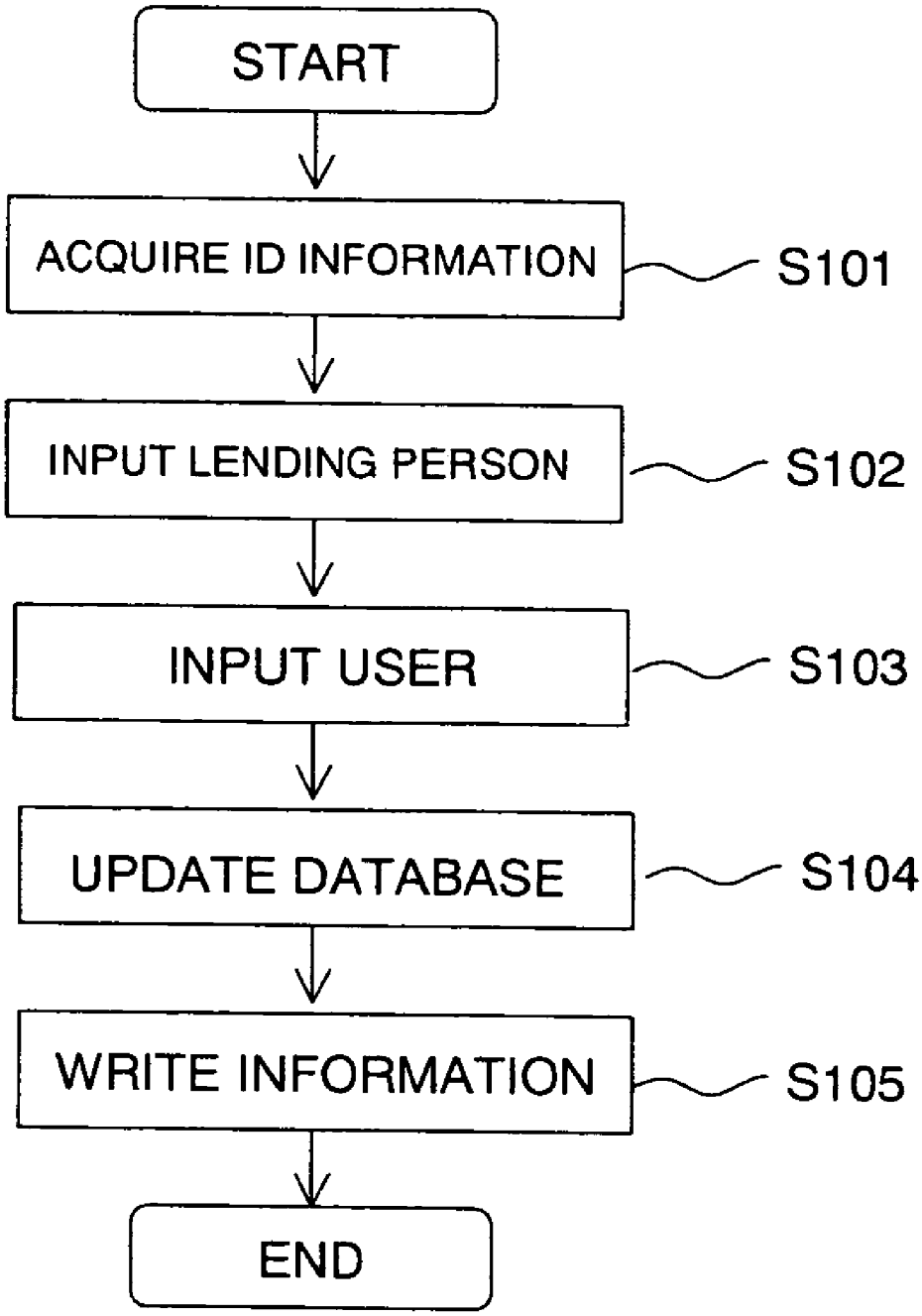
FIG. 3 is a flowchart for explaining a process in the lending information writing section 1.

FIG. 3 is a flowchart for explaining a process in the lending information writing section 1.

First, the ID information of the lending radio tag is acquired by the ID information acquiring section 101 (S101).

Subsequently, predetermined information to be written on the radio tag at the time of lending is input by the lending person input section (corresponding to a period-of-validity information writing section) 102 (S102). The predetermined information to be input here includes, for example, an information relating to a passable regular route for permitting an owner of the radio tag, a period of validity of the radio tag and a terminal for permitting the owner of the radio tag to be used. Incidentally, input of the predetermined information can be performed by inputting from a keyboard and the like. However, the present invention is not limited to this. For example, the predetermined information may be automatically written in an information writing section 105 after the ID information is acquired (S101).

Then, information (corresponding to the password information for taking the permission of the certification in the certifying section) which can be known only by a radio tag user using the radio tag is input by a user input section (corresponding to password information setting section) 103 (password information setting step) (S103). Here, as the information to be input by the user input section 103, for example, information including personal information, numeric characters, characters and the like are included. The inputting of the information by the user input section 103 may be executed at any time of a radio tag issuing, a radio tag lending and after the radio tag lending.

Then, the information input by the lending person input section 102 and the user input section 103 (corresponding to regular route information, period-of-validity information, personal information (corresponding to a password) and a usable terminal information and the like) are reflected to the database (storage section) 106 by the database updating section 104 (S104).

An information writing section (corresponding to the password information writing section) 105 writes the information (regular route information, period-of-validity information, personal information (corresponding to the password information set by the password information setting section) and usable terminal information and the like) reflected to the database 106 in the above-mentioned step (S104) on the radio tag (password information writing step)(S105). Incidentally, if a capacity of the information to be written in a recording memory of the radio tag is large, the part or the entirety of the information to be written may be stored in the database 106 by the database updating section 104. Even if there is a margin in the recording memory of the radio tag, only the information of the arbitrary part of the information to be written can be written on the radio tag.

Figure 4:
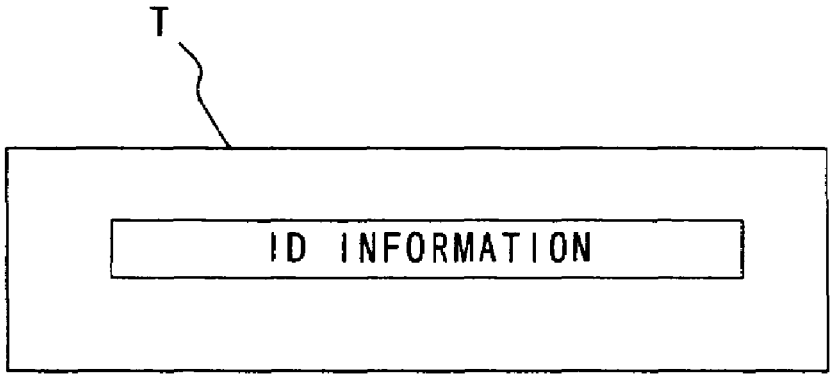
FIG. 4 is a view showing information stored in a radio tag T of an initialized state.
Figure 5:
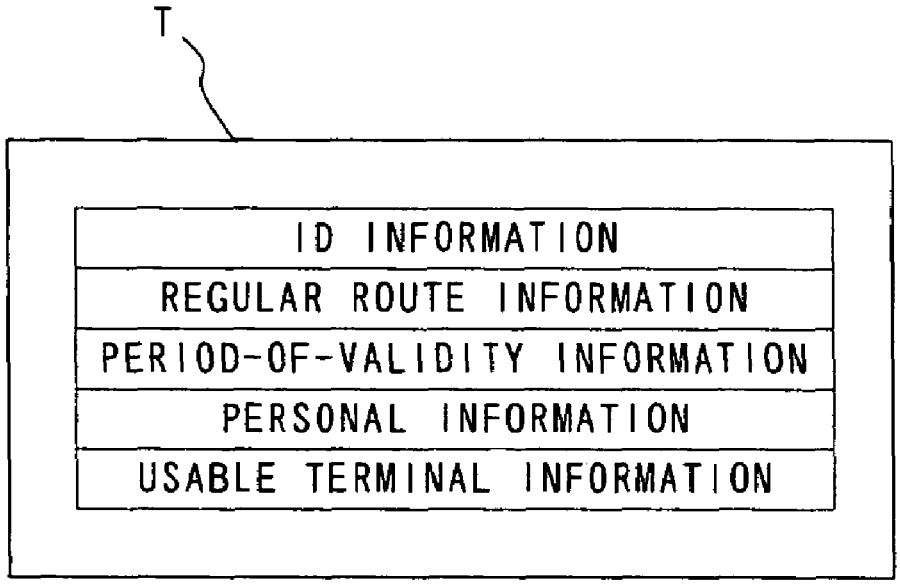
FIG. 5 is a view showing an information written on the radio tag T in the lending information writing section 1.

FIG. 4 shows information stored in the radio tag T of the initialized state and FIG. 5 shows information written on the radio tag T in the lending information writing section 1.

Figure 6:
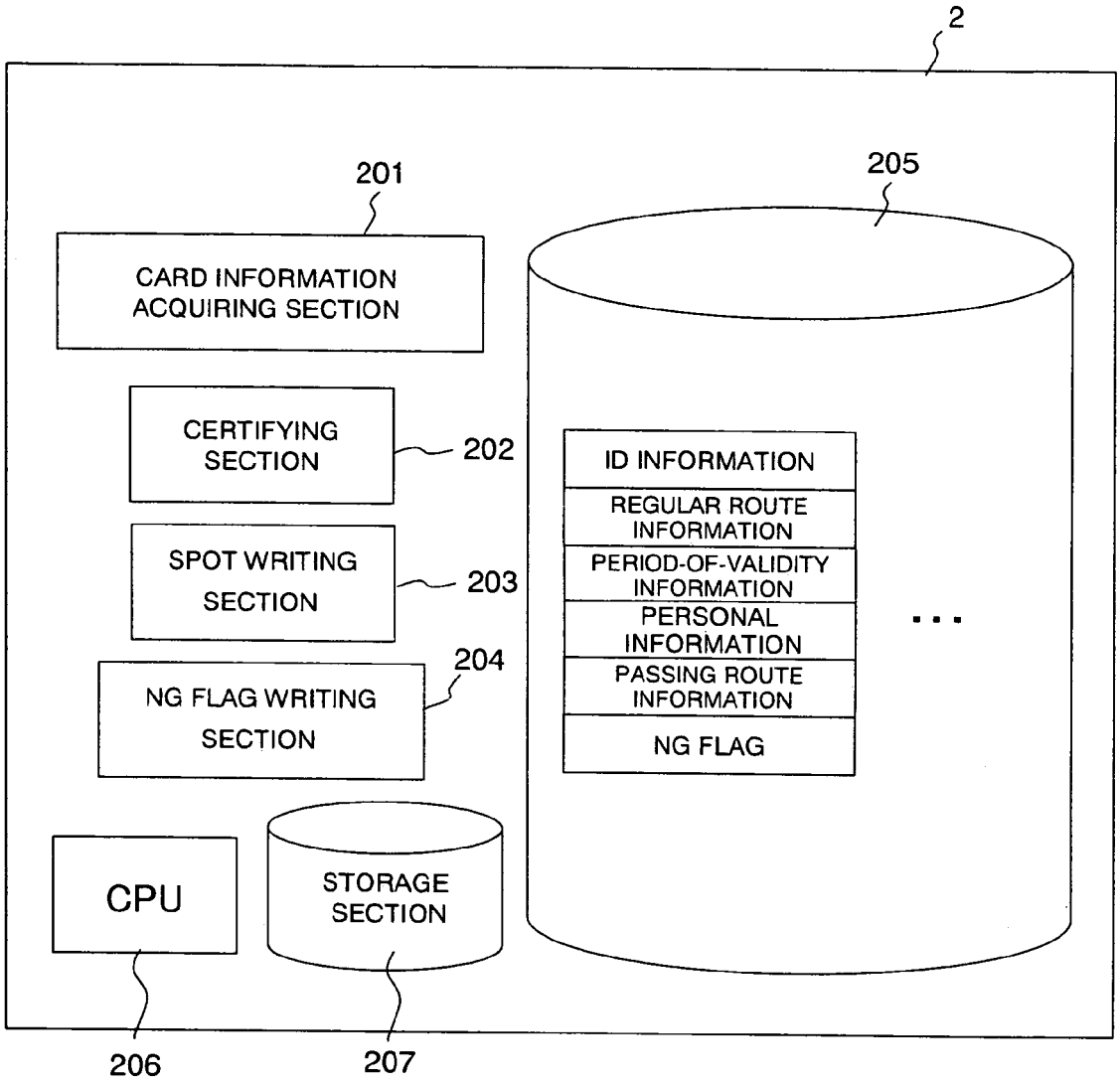
FIG. 6 is a functional block diagram for explaining the structure of a route information writing section 2.

The route information writing section 2 is disposed, for example, at an intersection and the like at a passage (predetermined route) from a guardhouse to a security room. FIG. 6 is a functional block diagram for explaining the structure of the route information writing section 2. The route information writing section 2 includes a card information acquiring section 201, a certifying section 202, a spot writing section 203 for writing information relating to the route passed by the radio tag to the radio tag passed through a predetermined route, an NG flag writing section 204, a database 205, a CPU 206 and a storage section 207. Here, the role as the read-write unit to the radio tag is realized by the card information acquiring section 201, the spot writing section 203 and the NG flag writing section 204.

Figure 7:
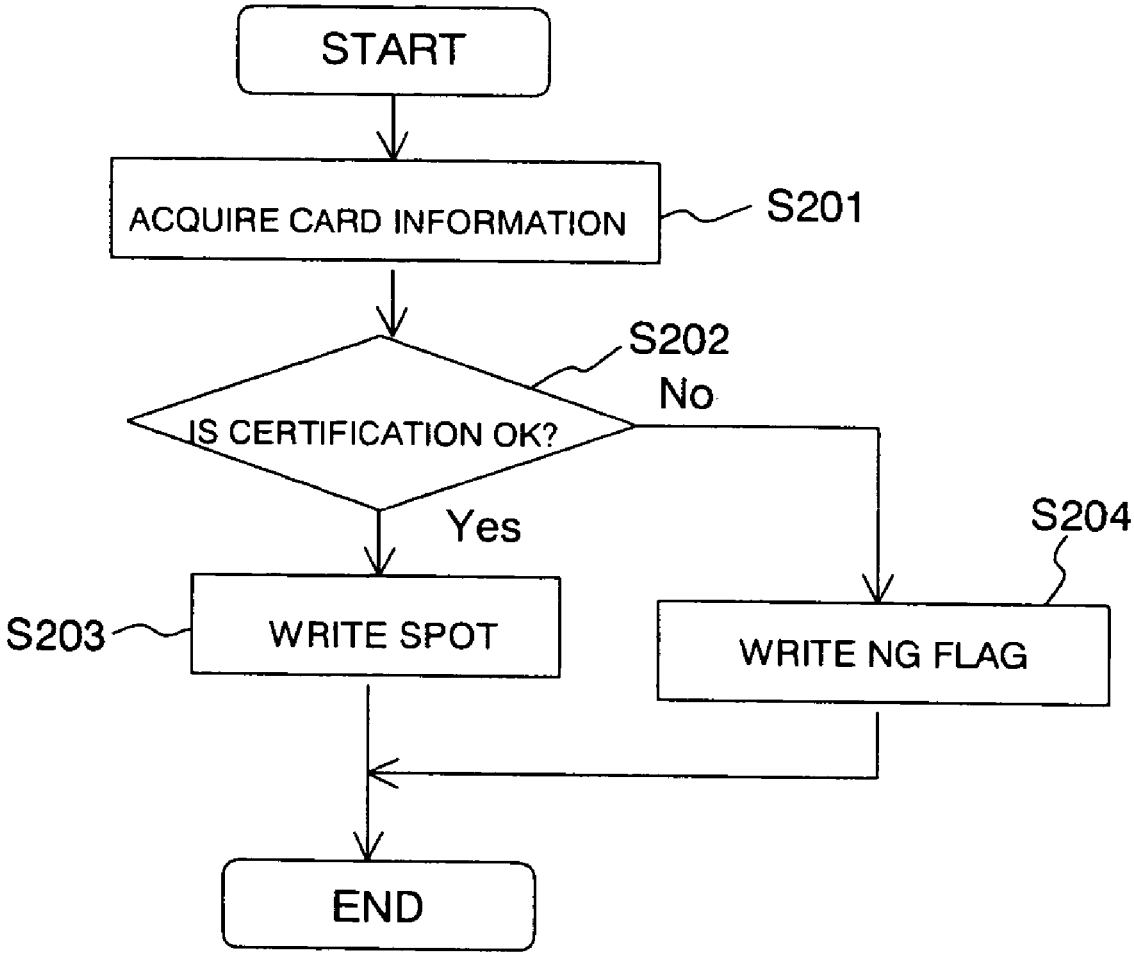
FIG. 7 is a flowchart for explaining a process in the route information writing section 2.

FIG. 7 is a flowchart for explaining a process in the route information writing section 2.

First, the information stored in the radio tag passing the vicinity of the route information writing section 2 is acquired by the card information acquiring section 201 (information acquiring step) (S201). The card information acquiring section 201 acquires the regular route information, the period-of-validity information and the passing spot information to the present time (information relating to the passing spot of the radio tag already written by the other route information writing section 2) (corresponding to the information relating to the route passed by the radio tag) from the radio tag based on the read ID information when the ID information of the radio tag is read. Here, as the information not stored in the radio tag, the information corresponding to the ID of the radio tag is acquired from the database 205.

Subsequently, the certifying section 202 executes a certifying process (checking the validity of the radio tag passing through the predetermined route) based on the information acquired by the card information acquiring section 201 (S202). More particularly, the certifying section 202 executes a certifying process of whether the passing spot information expressing the acquired passing route to the present time is the same as the information of the regular route (for example, a route A shown in FIG. 1) (whether an illegal route is traced or not), whether the period of validity is expired or not, whether the NG flag (to be described later) is not written or not (certifying step). In this certifying step, the certifying process is carried out based on the information relating to the route written on the radio tag acquired by the information acquiring step and the information relating to the regular route preset corresponding to the ID of the radio tag.

When the radio tag owner first passes the vicinity of the route information writing section 2, since the passing spot information is not yet written, the certifying process is executed based on the period of validity. The certifying section 202 does not permit the certification as to the radio tag of which the written period of validity expired.

As a result of the above-mentioned certifying process, in the case of permitting the certification (Yes in S202), the information (information relating to the route passed by the radio tag) relating to the passing spot corresponding to the route information writing section 2 is written on the radio tag by the spot writing section 203 (corresponding to the route information writing step and the position information writing step) (S203). In this manner, the information relating to the route passed by the radio tag written by the read-write unit is stored in the memory section of the radio tag.

On the other hand, if the certification is not permitted because of a reason of entering and passing through a route which is not regular (for example, a route B shown in FIG. 1) (No in S202), the NG flag writing section 204 writes an NG flag on the radio tag in order to inhibit the use of the radio tag (the certification is not permitted) (NG flag writing step) (S204). In this manner, the radio tag with the NG flag written is not permitted for the certification in the certifying process (S202) by the above-mentioned certifying section 202. Thus, the use of the abused ID card can be automatically inhibited.

Incidentally, the certifying method in the embodiment includes the above-mentioned respective steps (S201 to S204). The respective steps of this certifying method are carried out by executing the certifying program stored in the storage section 207 in a CPU 206.

Figure 8:
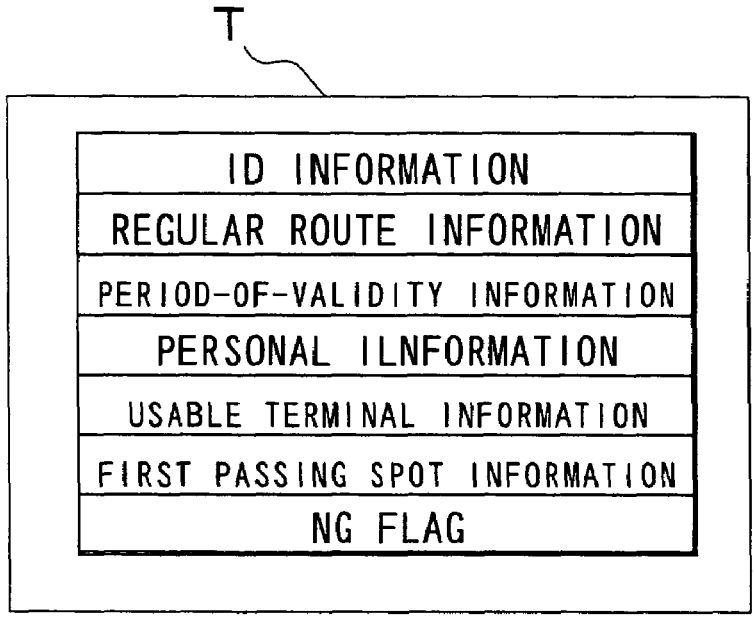
FIG. 8 is a view showing information in the radio tag with an NG flat written after initial passing spot information is written by the route information writing section 2.
Figure 9:
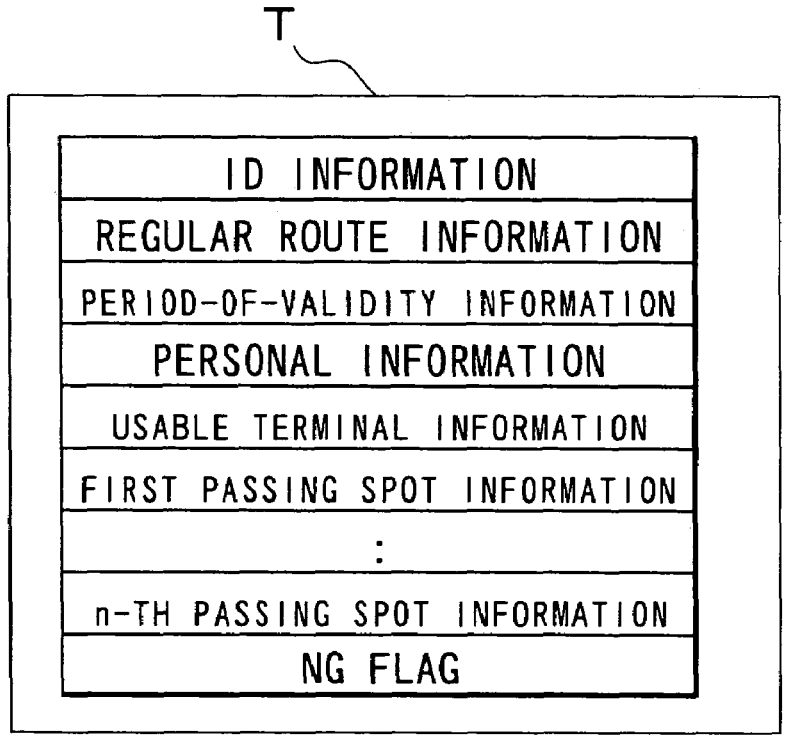
FIG. 9 is a view showing information in the radio tag with the NG flag written after information of first passing spot to n-th passing spot is written by the route information writing section 2.

As described above, a plurality of the route information writing sections 2 are installed from an entrance or a radio tag lending place to a place where an object door or a personal computer is provided. The position information is sequentially written on the radio tag by the route information writing sections 2, and are used for the determining conditions of whether the position information is regularly advanced at the time of certification. FIG. 8 shows the information in the radio tag with the NG flag written after the initial passing spot information is written by the route information writing section 2 and FIG. 9 shows the information in the radio tag with the NG flag written after the information of the first passing spot to n-th passing spot is written by the route information writing section 2.

More particularly, the route information writing section 2 includes a plurality of spot writing sections 203 that are disposed along the predetermined route and each of which writes information relating to the route passed by the radio tag on the radio tag passing through the predetermined route, a card information acquiring section (route information acquiring section) 201 that acquires information relating to the route written on the radio tag by the spot writing section 203, and a certifying section 202 for certifying based on the information relating to the route written on the radio tag acquired by the card information acquiring section 201 and the information relating to the regular route preset corresponding to the ID of the radio tag.

With the structure thus formed, the radio tag passing, for example, through the route except the preset regular route can be automatically refused for the certification because of the illegal use not passing the regular route. That is, it can contribute to the prevention of the abuse of the ID card and the reduction in the man-hours required for managing the security system.

As described above, the certification cannot be taken by the ID card after the period of validity has expired by writing the period-of-validity information on the radio tag. In this manner, even if the theft of the ID card is not noticed, the abuse of the ID card for a long period exceeding the above-mentioned period of validity can be prevented.

Figure 10:
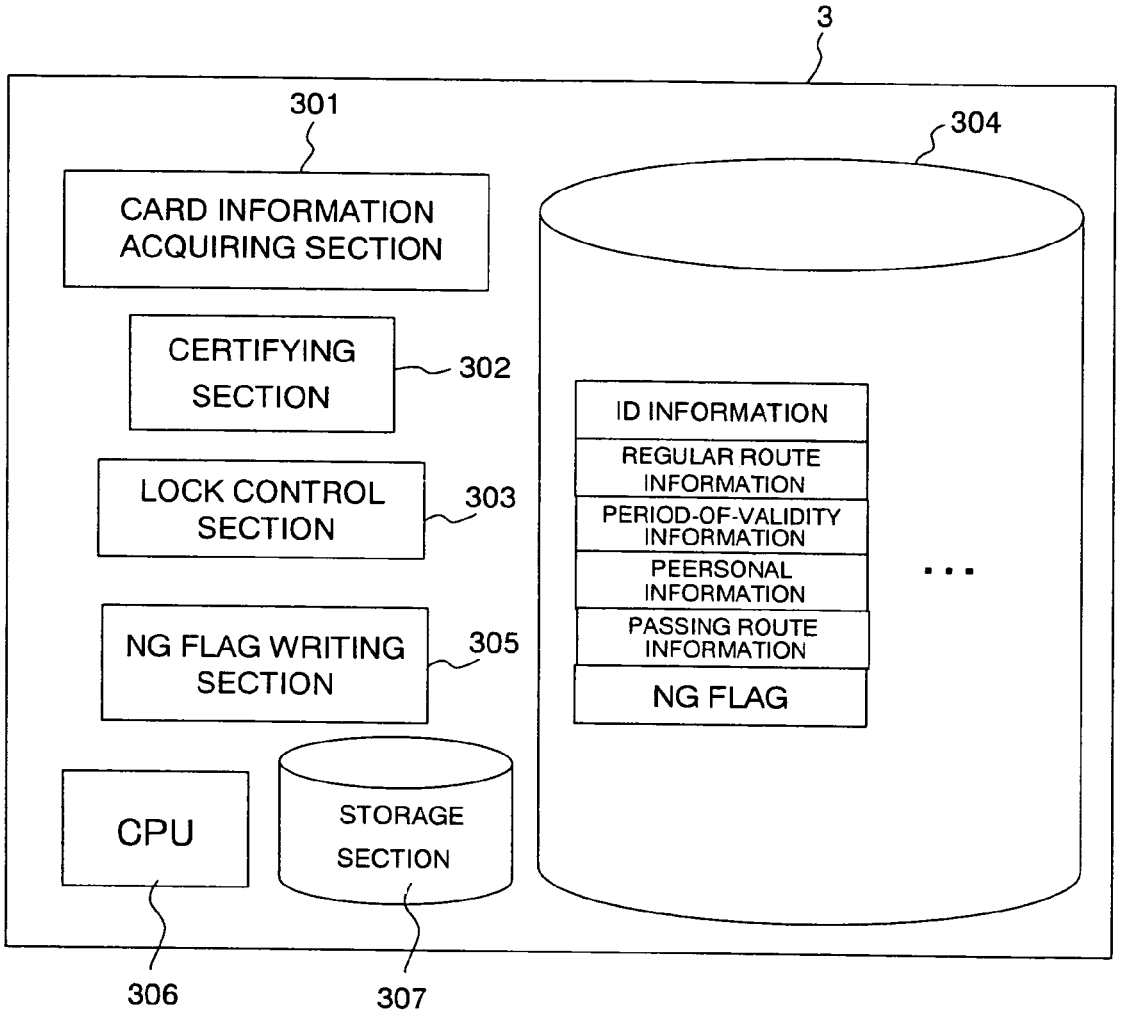
FIG. 10 is a functional block diagram for explaining the structure of a gate lock control section 3.

The gate lock control section 3 is disposed near a gate 91 and a gate 92. FIG. 10 is a functional block diagram for explaining the structure of the gate lock control section 3. The gate lock control section 3 includes a card information acquiring section 301, a certifying section 302, a lock control section 303, an NG flag writing section 305, a database 304, a CPU 306 and a storage section 307. Here, a role as a read-write unit to the radio tag is realized by the card information acquiring section 301 and the NG flag writing section 305.

Figure 11:
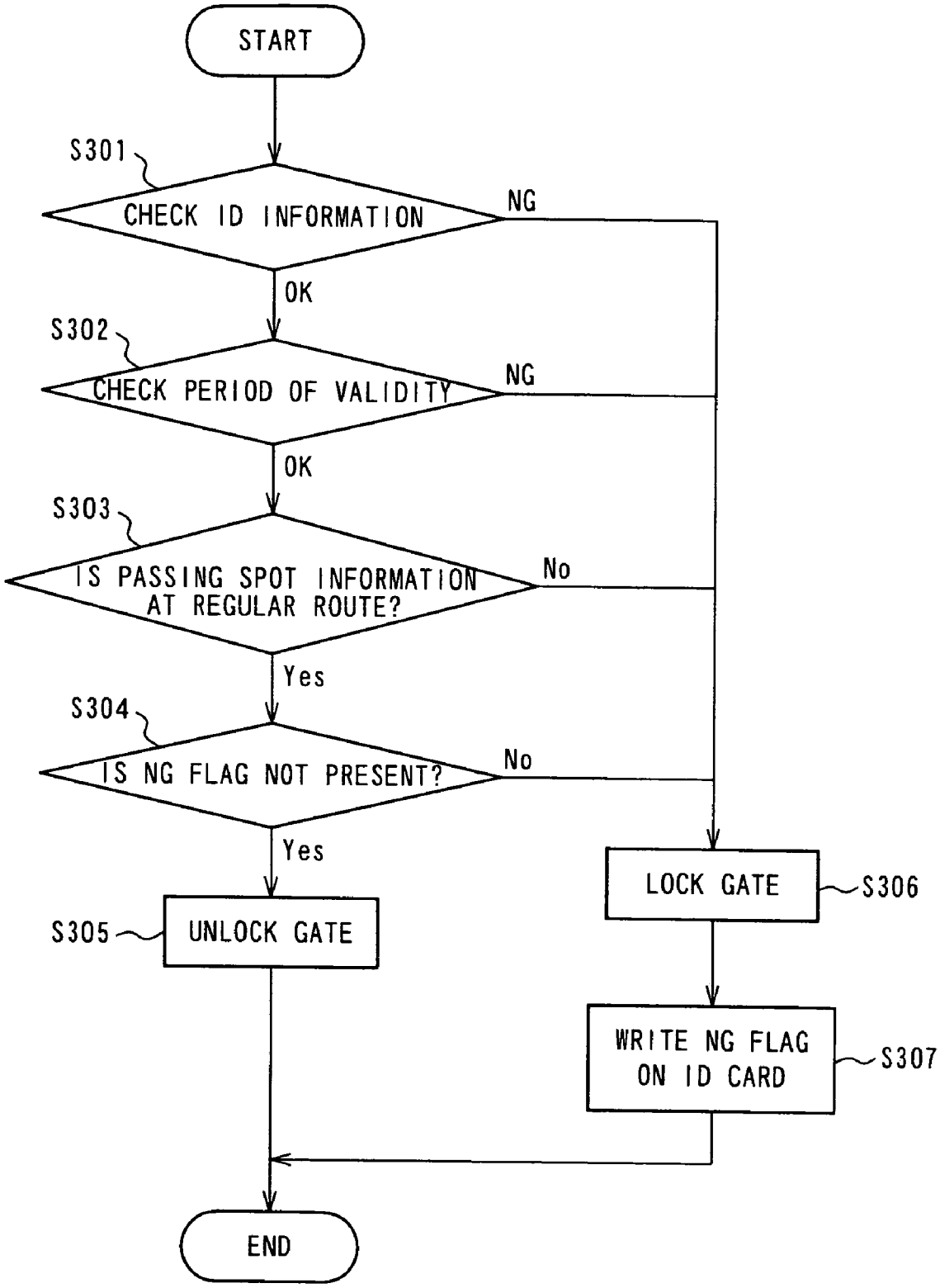
FIG. 11 is a flowchart for explaining a process in the gate lock control section 3.

FIG. 11 is a flowchart for explaining a process in the gate lock control section 3.

First, the ID information written on the radio tag is acquired, and information (period of validity, passing spot information (information relating to the route passed by the radio tag) and the like) corresponding to the ID information is acquired from the radio tag or the database 304 (information acquiring step) (S301).

The certification is executed based on the information written on the radio tag acquired by the information acquiring step and the information relating to the regular route preset corresponding to the ID of the radio tag (certifying step) (S302 to S304). More particularly, the certification of whether the period of validity expired or not (S302), whether the passing spot information becomes a regular route or not (S303) and whether the NG flag is not present or not (S304) are executed.

If the certification is permitted in the certifying section (Yes in S304), the gate 91 or the gate 92 is unlocked by the lock control section 303 (S305).

On the other hand, if the certification is not permitted in the certifying section, the gate installed on a predetermined route is locked (gate lock control step) (S306), and the NG flag is written on the radio tag by the NG flag writing section 305 (S306).

The certifying method according to this embodiment is constructed by the above-mentioned respective steps (S301 to S307). The respective steps of the certifying method are realized by executing the certifying program stored in the storage section 307 by the CPU 306.

As such a structure thus formed, a person who abuses the ID card (that is, a person having no authority of passing the gate) can be prevented, and it can contribute to the improvement in the security level.

Incidentally, although the gate lock control sections 3 are disposed at the passage and the entrance of the security room, the gate lock control section 3 may be disposed at any one of the passage and the security room.

Figure 12:
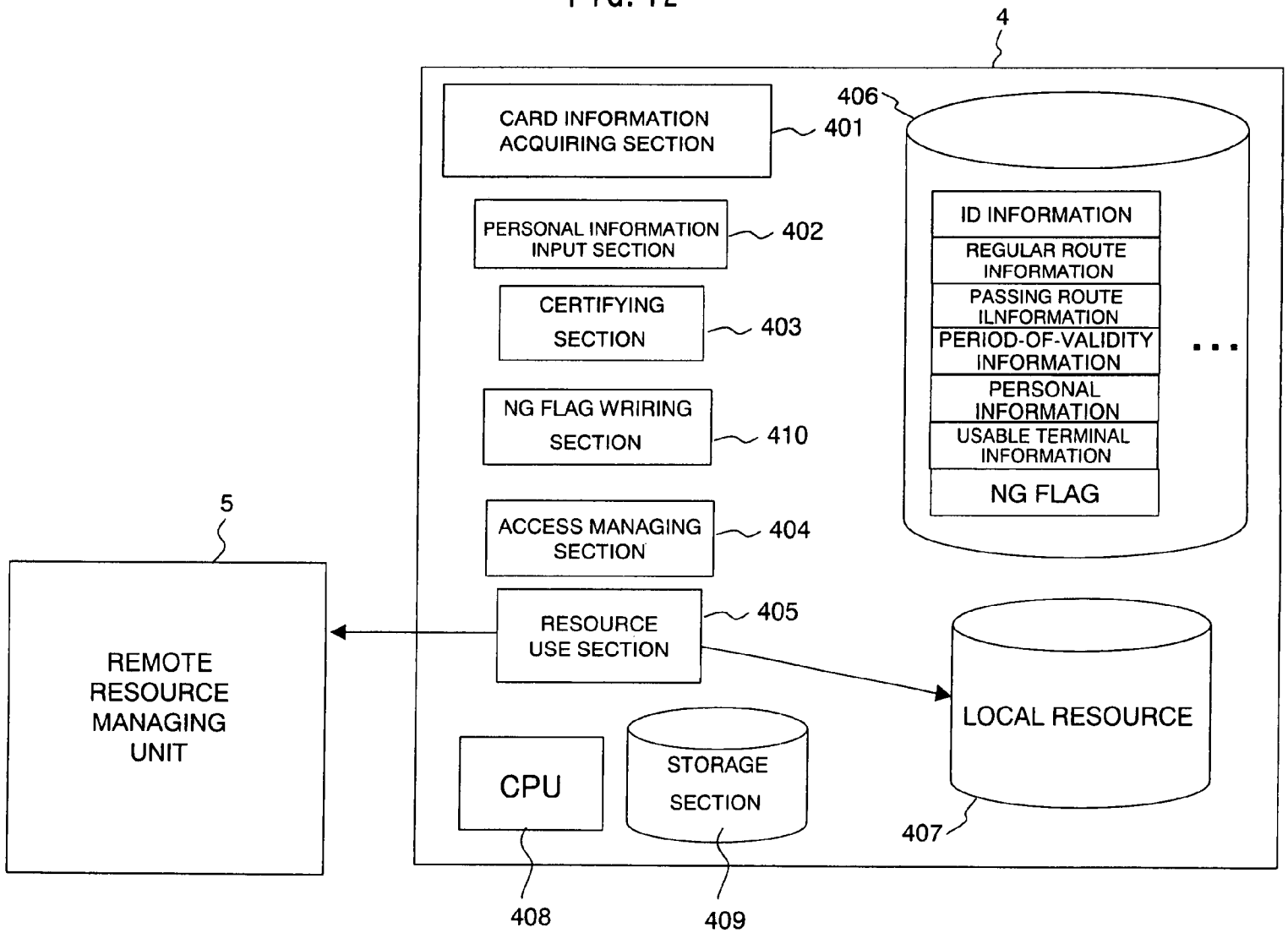
FIG. 12 is a functional block diagram for explaining the structure of a resource use terminal 4.

The resource use terminal 4 is disposed, for example, in the security room. FIG. 12 is a functional block diagram for explaining the structure of the resource use terminal 4. The resource use terminal 4 includes a card information acquiring section (corresponding to the password information acquiring section) 401, a personal information input section 402, a certifying section 403, an access managing section 404, a resource use section 405, a database 406, a local resource 407, a CPU 408, a storage section 409, and an NG flag writing section 410. Here, the role as a read-write unit to the radio tag is realized by the card information acquiring section 401 and the NG flag writing section 410. The personal information input section 402 includes, for example, a keyboard and a mouse.

Figure 13:
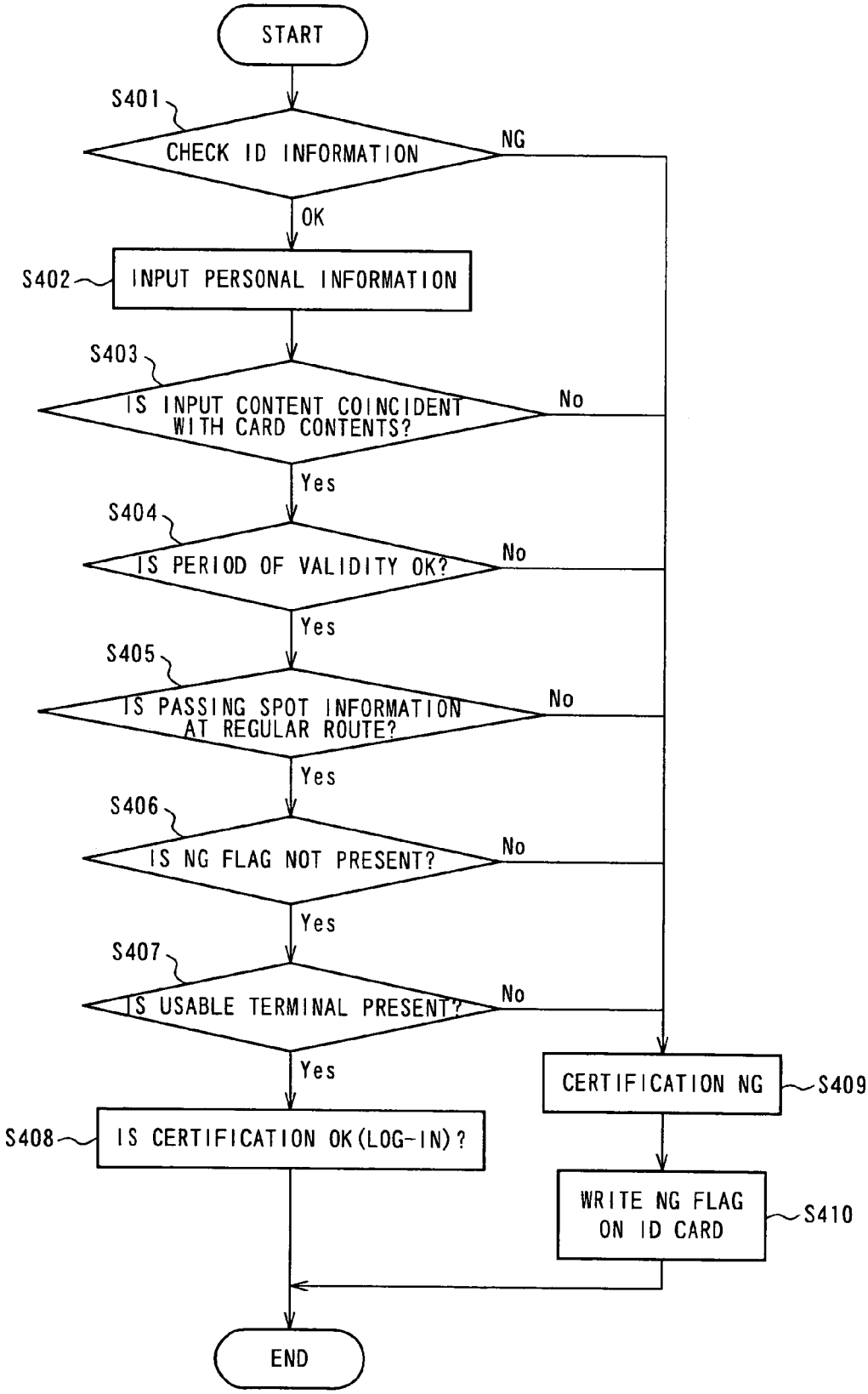
FIG. 13 is a flowchart for explaining a process of the resource use terminal 4.

FIG. 13 is a flowchart for explaining a process in the resource use terminal 4.

First, the ID information of the radio tag is acquired by the card information acquiring section 401, and the information corresponding to the ID information (personal information (corresponding to the password information written on the radio tag by the password information writing section) a period of validity, a passing spot information (information relating to the route passed by the radio tag), usable terminal information and the like) are acquired from the radio tag or the database 304 (password information acquiring step) (S401).

Subsequently, the personal information (password information) used for comparing with the personal information (password information) set by the above-mentioned user input section 103 is input by the personal information input section (corresponding to the password information input section) 402 (password information input step) (S402).

The certifying section 403 executes the certification based on the password information written on the radio tag acquired by the card information acquiring section 401 (password information acquiring section) and the personal information input by the personal information input section 402 (S403), and the certification whether the period of validity does not expire (S404), whether the information of the passing spot is on a regular route or not (S405), whether the judgment of the presence or absence of the NG flag (S406) and whether the resource use terminal 4 can be used by the radio tag owner or not (S407) (certifying step).

As a result of the above-mentioned certifying process (S403 to S407), if the certification is permitted (Yes in S407), the process of accessing and the like to the log-in to the resource use terminal 4 and the local resource of the resource use terminal 4 is permitted (S408).

On the other hand, if the certification is not permitted (No in S407), the NG flag is written on the radio tag by the NG flag writing section 410 (S410) as the certification NG (S409).

Incidentally, the certifying method in this embodiment comprises the above-mentioned steps (S401 to S410). The steps of the certifying method are realized by executing the certifying program stored in the storage section 409 by the CPU 408.

As described above, in addition to the certification based on the period of validity, the NG flag, and the passing spot information, the certification for identifying an individual is executed for the owner of the radio tag (ID card) passing through the regular route. Thus, even if the stolen ID card owner passes through the regular route, the certification can be refused.

Figure 14:
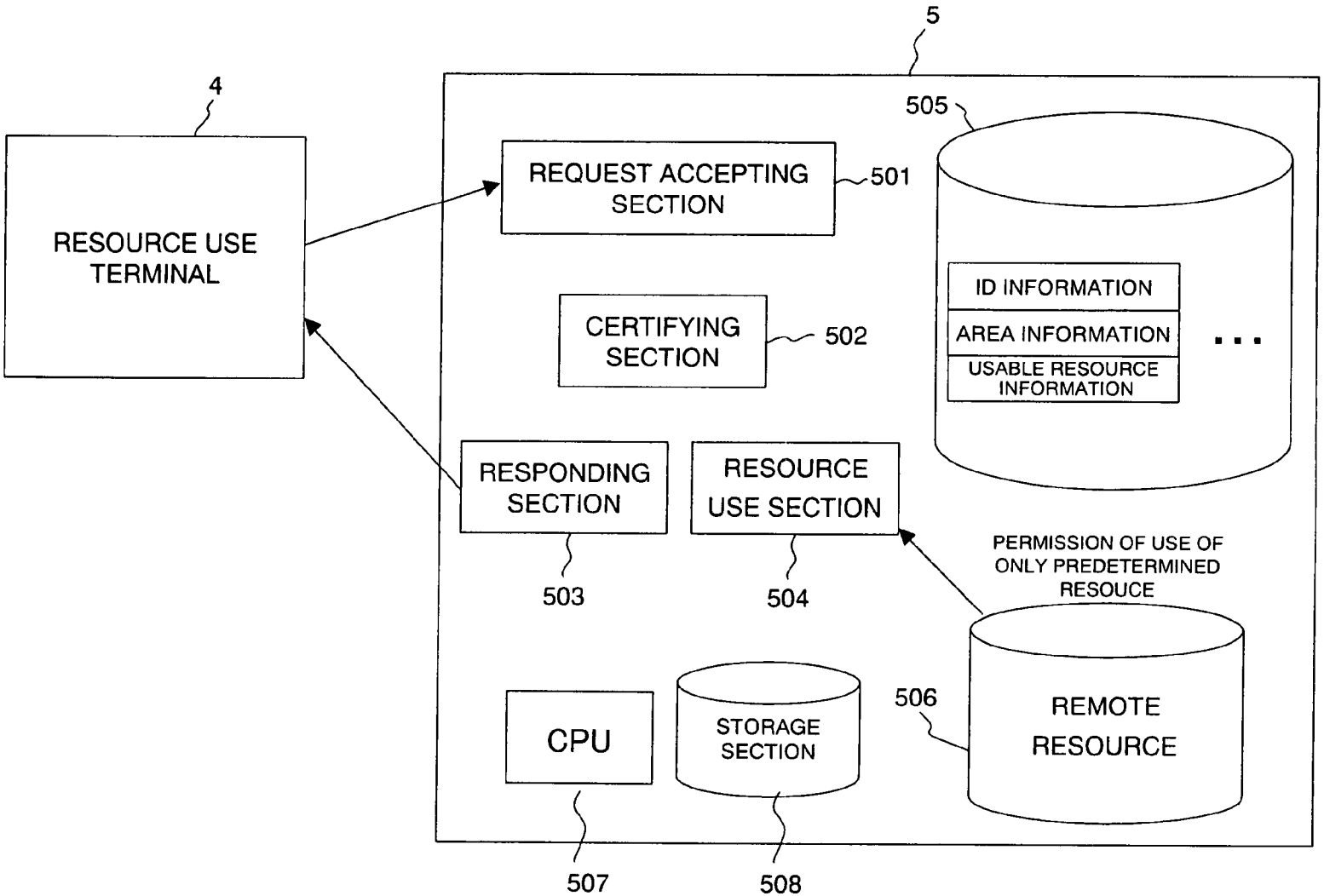
FIG. 14 is a functional block diagram for explaining the structure of a remote resource managing unit 5.

FIG. 14 is a functional block diagram for explaining the structure of the remote resource managing unit 5.

The remote resource managing unit 5 is connected to the resource use terminal 4 in a communicable manner through a telecommunication line. The disposing place of the remote resource managing unit 5 may be a remote place. The remote resource managing unit 5 manages the information resources at a place separate from the resource use terminal 4, receives a resource use request from the resource use terminal 4, and has a role of returning a response to the request.

The remote resource managing unit 5 includes a request accepting section 501, a certifying section 502, a responding section 503, a resource use section 504, a database 505, a remote resource 506, a CPU 507 and a storage section 508.

The request accepting section 501 has a role of accepting a request from the resource use terminal 4. The resource use section 504 has a role of managing the remote resource 506 of data acquisition and the like from the remote resource 506 based on the request from the resource use terminal 4.

The database 505 stores information of the remote resources that can be used by the owner of the radio tag corresponding to the ID information of the radio tag, and area information specifying an accessible request transmitting place. An access request only from the place is accepted, for the owner of the radio tag.

Figure 15:
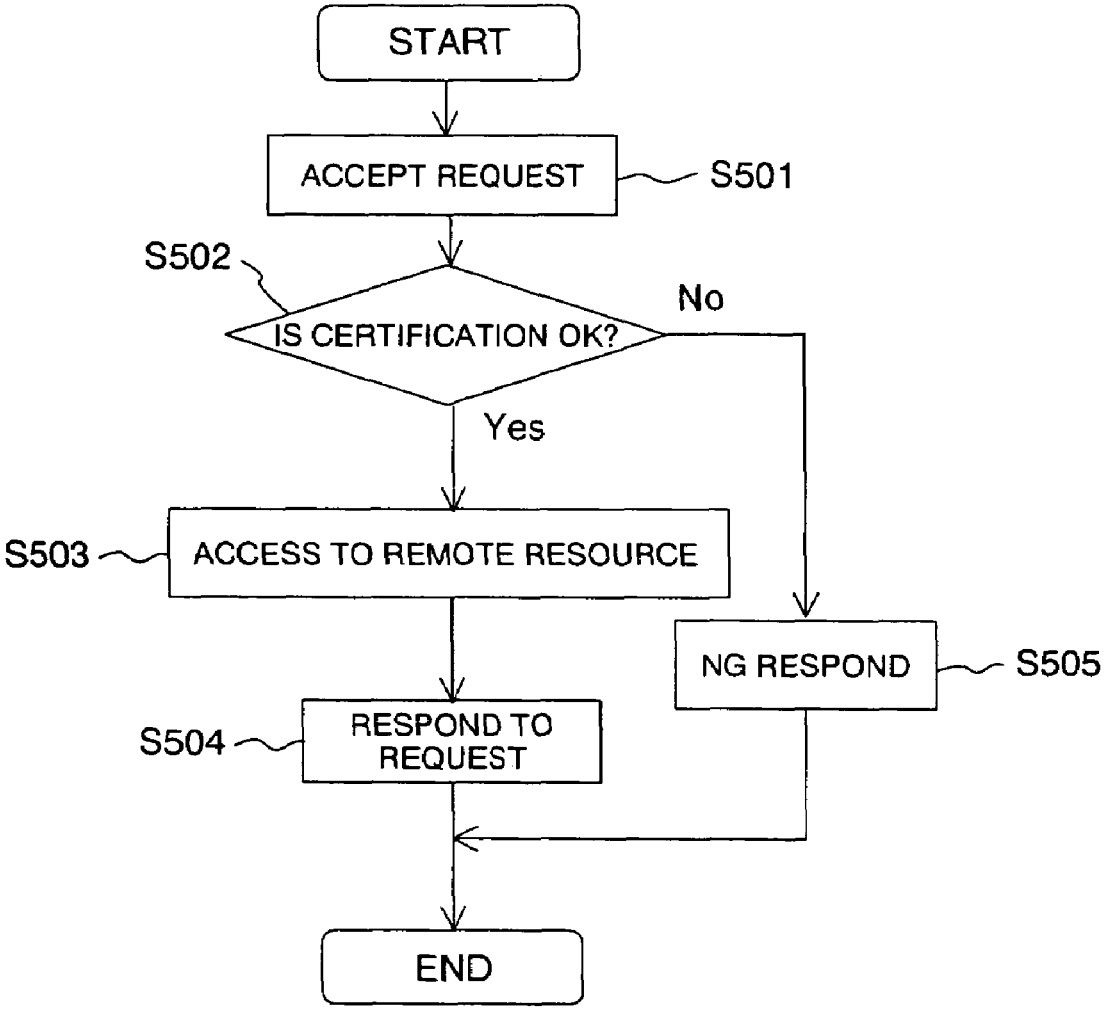
FIG. 15 is a flowchart for explaining a process in the remote resource managing unit 5.

FIG. 15 is a flowchart for explaining a process in the remote resource managing unit 5.

First, the access request to the remote resource 505 from the resource use terminal 4 is accepted by the request accepting section 501. Here, a user who executes the accessing request to use the resource use terminal 4 receives certification. Therefore, the request accepting section 501 acquires the ID information of the resources requested for the user present position, the user ID and the access by the user who executes the request (information acquiring step) (S501).

The acquisition of the present position and the user ID of the user who executes the request of the accessing in the request accepting section 501 is executed by acquiring the ID information and the passing route information acquired from the user's radio tag by the resource use terminal 4 at the user certifying time to the resource use terminal 4. It is noted that the acquisition of the above-mentioned user present position may be acquired from the resource use terminal 4 or the database 505. Here, the passing route information (information of the passing spot) acquired from the radio tag by the resource use terminal 4 has a role as information relating to the route passed by the radio tag and a role as the information relating to the present position of the radio tag. However, the present invention is not limited to the particular embodiment. For example, information relating to the passing route and information relating to the present position are divided in the above-mentioned spot writing section 203, and are written on the radio tag, and these information can be separately acquired by the request accepting section 501.

Then, the certifying section 502 executes certification (determines whether the accessing is from a valid place or not) based on the information relating to the present position of the radio tag and the area information acquired by the request accepting section 501 (S502). The certifying process of judging the presence or absence of the NG flag can be executed as well as the judgment whether or not the period-of-validity expired in the certifying section 502.

As a result of the above-mentioned certifying process (S502), if the certification is permitted (Yes in S502), the resource use section 504 acquires the information of the remote resource 506 based on the ID information of the resource required to the access acquired in the request accepting section 501. At this time, the resource use section 504 acquires only the resource permitted for the use of the ID information acquired from the user radio tag based on the usable resource information stored in the database 505 (S503).

Subsequently, the responding section 503 transmits the information acquired by the resource use section 504 to the resource use terminal 4 (S504). In this manner, if the certification is permitted by the certifying section, only the predetermined process (here, accessing to the predetermined remote resource) to be permitted at the present position is permitted based on the information relating to the present position acquired in the information acquiring step (process permitting step). Here, the certifying section 502 and the resource use section 504 correspond to the process permitting section.

On the other hand, if the certification is not permitted (No in S502), the responding section 503 transmits the NG response which is not permitted for the certification to the resource use terminal 4 (S505).

The certifying method according to this embodiment includes the above-mentioned respective steps (S501 to S505), and the respective steps of this certifying method are realized by executing the certifying program stored in the storage section 508 by the CPU 507.

In the above-mentioned embodiment, the information written dynamically on the radio tag is used for the certification. However, the present invention is not limited to this embodiment. For example, a portion of the information used for the certification (for example, a regular route information and the like) may be previously written in a fixed manner (without changing) on the radio tag to be lent.

As described above, a date, a period of validity, position information, route information, personal information and the like are dynamically written on the radio tag, and these information are also used at the certifying time. Thus, even if the ID card is stolen, since the certification cannot be executed only by static information written fixedly on the ID card, this can contribute to the improvement in the security level.

Further, in the certification executed by writing the information of the route passed by the radio tag on the radio tag, the writing itself of the NG flag on the radio tag means the illegal use. Therefore, even if the submission and the like of a report of the loss of the radio tag are not executed, the illegal use of the ID card can be prevented. Further, the certification NG except the above-mentioned illegal use is judged to be illegal, and the ID card itself is made not to be available by writing the NG flag by a reader-writer of the radio tag used at the certifying time without processing at the managing side of the security system.

In the embodiment described above, the respective steps of the certifying method according to this embodiment are respectively individually executed by the lending information writing section 1, the route information writing section 2, the gate lock control section 3, the resource use terminal 4 and the remote resource managing unit 5. However, the present invention is not limited to the particular embodiment described above. For example, the respective steps (S101 to S105, S201 to S204, S301 to S307, S401 to S410, and S501 to S505) in the lending information writing section 1, the route information writing section 2, the gate lock control section 3, the resource use terminal 4 and the remote resource managing unit 5 may be realized as an overall certifying system.

As described above, although description has been made with respect to the embodiment of the present invention, the present invention is not limited hitherto. The present invention may be embodied in other specific forms without departing from the scope of the present invention. Various types of the invention may be formed by suitable combinations of a plurality of the constituting elements disclosed in the above-mentioned embodiment. For example, some constituting elements may be deleted from the entire constituting elements shown in the above-mentioned embodiment. Further, the constituting elements of the different embodiments may be suitably combined.

What is claimed is:

1. A certifying system for checking validity of a radio tag passing through a predetermined route comprising:

a route information writing section, disposed along the predetermined route, that writes information relating to a route passed by the radio tag on the radio tag, a route information acquisition section that acquires the information relating to the route written on the radio tag by the route information writing section, a storage section that stores information relating to a regular route preset corresponding to the ID of the radio tag, and a certifying section that checks the validity based on the information relating to the route written on the radio tag acquired by the route information acquisition section and the information relating to the regular route stored in the storage section.

2. The certifying system according to claim 1, wherein the information relating to the route passed by the radio tag includes the information relating to the passing spot of the radio tag.

3. The certifying system according to claim 1, further comprising:

an NG flag writing section that writes an NG flag for inhibiting the use of the radio tag not permitted for the certification in the certifying section, wherein the certifying section does not permit the certification for the radio tag written by the NG flag.

4. The certifying system according to claim 1, further comprising a gate lock control section that unlocks and locks a gate installed on the predetermined route, wherein the gate lock control section locks the gate if the certification is not permitted in the certifying section.

5. The certifying system according to claim 1, further comprising:

a period-of-validity information writing section that writes a period of validity of the radio tag on the radio tag, wherein the certifying section does not permit the certification for the radio tag of which the written period of validity expired.

6. The certifying system according to claim 1, further comprising:

a password information setting section that sets password information for taking the permission of the certification in the certifying section, a password information writing section that writes password information set by the password information setting section on a radio tag, a password information acquisition section that acquires the password information written on the radio tag by the password information writing section, and a password information input section that inputs password information used for comparing with the password information set by the password information setting section, wherein the certifying section certifies based on password information written on the radio tag acquired by the password information acquisition section and password information input by the password information input section.

7. A certifying method comprising:

a route information writing step of writing information relating to the route passed by the radio tag to the radio tag disposed along a predetermined route and passing the predetermined route, a route information acquiring step of acquiring information relating to the route written on the radio tag in the route information writing step, and a certifying step of certifying based on information relating to the route written on the radio tag acquired in the route information acquiring step and information relating to the regular route preset corresponding to the ID of the radio tag.

8. The certifying method according to claim 7, wherein the information relating to the route passed by the radio tag includes information relating to the passing spot of the radio tag.

9. The certifying method according to claim 7, further comprising:

an NG flag writing step of writing an NG flag for inhibiting the use of the radio tag not permitted for the certification in the certifying step, wherein the certifying step does not permit the radio tag with the NG flag written.

10. The certifying method according to claim 7, further comprising:

a gate lock control step of unlocking and locking a gate installed on the predetermined route, wherein the gate lock control step locks the gate if the certification is not permitted in the certifying step.

11. The certifying method according to claim 7, further comprising:

a period-of-validity information writing step of writing a period of validity of the radio tag on the radio tag, wherein the certifying step does not permit the certification for the radio tag of which the written period of validity expired.

12. The certifying method according to claim 7, further comprising:

a password information setting step of setting password information for taking the permission of the certification in the certification step, a password information writing step of writing the password information set by the password information setting step on the radio tag, a password information acquiring step of acquiring the password information written on the radio tag by the password information writing step, and a password information inputting step of inputting the password information used for comparing with the password information set by the password information setting step, wherein the certifying step certifies based on the password information written on the radio tag acquired by the password information acquiring step and the password information input by the password information inputting step.

13. The certifying method according to claim 7, further comprising:

a position information writing step of writing the information relating to the present position of the radio tag on the radio tag, and a process permitting step of permitting only a predetermined process to be permitted at the present position based on the information relating to the present position written on the radio tag.

14. A computer-readable medium encoded with a data structure for performing a certifying method, the method comprising:

an information acquiring step of acquiring information relating to a route passed by the radio tag and written on the radio tag, a certifying step of certifying based on the information relating to the route written on the radio tag acquired by the information acquiring step and the information relating to a regular route preset corresponding to the ID of the radio tag, and a route information writing step of writing the information relating to the route passed by the radio tag to the radio tag permitted by the certification in the certifying step.

15. The computer-readable medium according to claim 14, the certifying method further comprising an NG flag writing step of writing the NG flag for inhibiting the use to the radio tag not permitted for the certification in the certifying step, wherein the certifying step does not permit the certification for the radio tag with the NG flag written.

16. A computer-readable medium encoded with a data structure for performing a certifying method, the method comprising:

an information acquiring step of acquiring the information relating to a route passed by a radio tag and written on the radio tag, a certifying step of certifying based on the information relating to the route written on the radio tag acquired by the information acquiring step and the information relating to a regular route preset corresponding to the ID of the radio tag, and a gate lock control step of locking the gate installed on the predetermined route if the certification is not permitted in the certifying section.

17. The computer-readable medium certifying-program according to claim 16, the certifying method further comprising:

an NG flag writing step of writing the NG flag for inhibiting the use on the radio tag not permitted for the certification in the certifying step, wherein the certifying step does not permit the certification for the radio tag with the NG flag written.

18. A computer-readable medium encoded with a data structure for performing a certifying method, the method comprising:

an information acquiring step of acquiring information relating to a route passed by a radio tag and written on the radio tag, and a certifying step of certifying based on the information relating to the route written on the radio tag acquired by the information acquiring step and the information relating to a regular route preset corresponding to the ID of the radio tag.

19. A computer-readable medium encoded with a data structure for performing a certifying method, the method comprising:

an information acquiring step of acquiring information relating to a route passed by a radio tag, written on the radio tag and information relating to the present position of the radio tag, written on the radio tag, a certifying step of certifying based on the information written on the radio tag acquired by the information acquiring step and the information relating to a regular route preset corresponding to the ID of the radio tag, and a process permitting step of permitting only a predetermined process to be permitted at the present position based on the information relating to the present position acquired by the information acquiring step if the certification is permitted in the certifying section.

* * * * *